United States Patent [19]

Hsu C.S.

[11] Patent Number: 5,002,417

[45] Date of Patent: Mar. 26, 1991

[54] DETACHABLE PHOTOALBUM

[76] Inventor: Junior Hsu C.S., 4 Fl. No. 16, Mintsu E. Road, Taipei, Taiwan

[21] Appl. No.: 437,695

[22] Filed: Nov. 17, 1989

[51] Int. Cl.[5] ..... B42F 13/32

[52] U.S. Cl. ..... 402/77; 40/537

[58] Field of Search ..... 40/376, 380, 388, 537, 40/530, 533; 402/46, 77, 76, 75, 73, 70; 206/424, 472, 473

[56] References Cited

U.S. PATENT DOCUMENTS

| | | | |
|---|---|---|---|
| 719,673 | 2/1903 | Jones | 402/75 |
| 845,390 | 2/1907 | Baughman et al. | 402/77 |
| 4,227,328 | 10/1980 | Clipper, Jr. | 40/530 |

FOREIGN PATENT DOCUMENTS

| | | | |
|---|---|---|---|
| 1217922 | 6/1966 | Fed. Rep. of Germany | 402/70 |
| 2103153 | 2/1983 | United Kingdom | 402/75 |

*Primary Examiner*—Peter R. Brown
*Assistant Examiner*—J. Bonifanti
*Attorney, Agent, or Firm*—Lalos & Keegan

[57] ABSTRACT

A detachable photoalbum, which comprises two opposite casings, covered by related covers with folding lines; a side casing connected between the opposite casings, a binder means with at least two sticks, and a plurality of loose bags. Each bag has inserted therein a sheet to divide the bag into two halves and has formed thereon at least two holes so as to be hanged on the sticks.

The combinations of opposite casings and side casing, and the binder means and the side casing are finished by the technique of pins and holes. And above casings and binder means are made of elastic material, such as plastic or acryl resin, therefore the photoalbum is easily detached and assembled as an ordinary cassette.

4 Claims, 4 Drawing Sheets

DETACHABLE PHOTOALBUM

BACKGROUND OF THE INVENTION

The present invention relates to a kind of photoalbum, and more particularly to the one which comprises a binder means and is detachable.

A conventional photoalbum has its shortcomings of limited volume and fixed binding or bags to contain pictures. Therefore, it is not convenient for those picture collectors, especially to those own a great number of pictures to frequently change their album when the former one is filled with pictures, or to rearrange the pictures collected in above photoalbum because they have to draw the picture out of one bag than put it in another one.

SUMMARY OF THE INVENTION

Accordingly, it is an object of the present invention to provide a kind of photoalbum which comprises a binder means and a desired number of loose bags to contain pictures, whereby the collector also can conveniently rearrange the pictures.

Another object of the present invention is to provide above photoalbum which is easily detachable and assembled as an ordinary cassette.

Other objects and advantages of the present invention will be apparent from a reading of the following detail description, taken in conjunction with the fingers of the accompanying drawings, in which:

DETAILED DESCRIPTION OF THE PREFERRED EMBODIMENT

Figure 1:
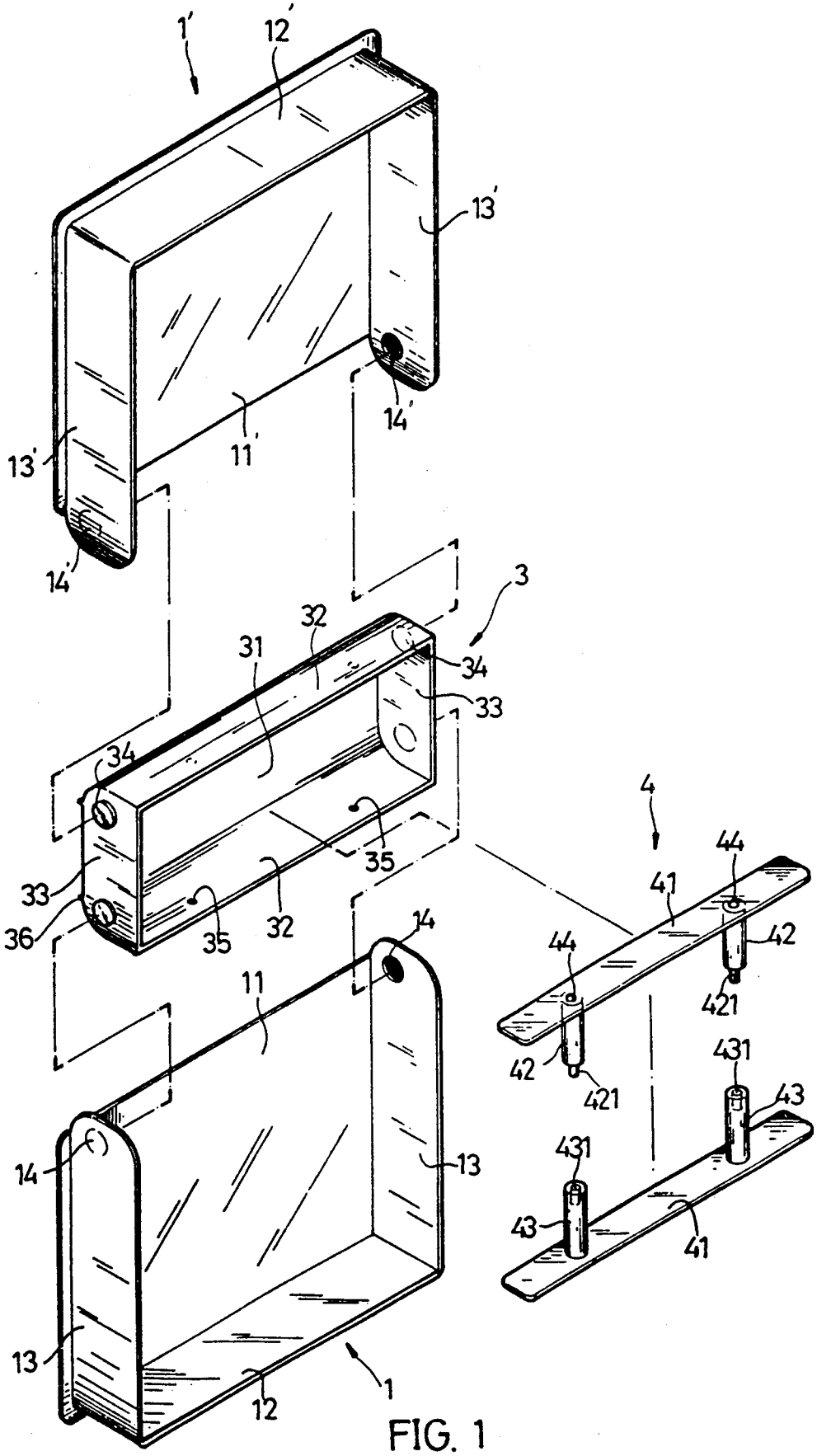
FIG. 1 is a perspective fragmentary view of the present invention except loose bags.
Figure 2:
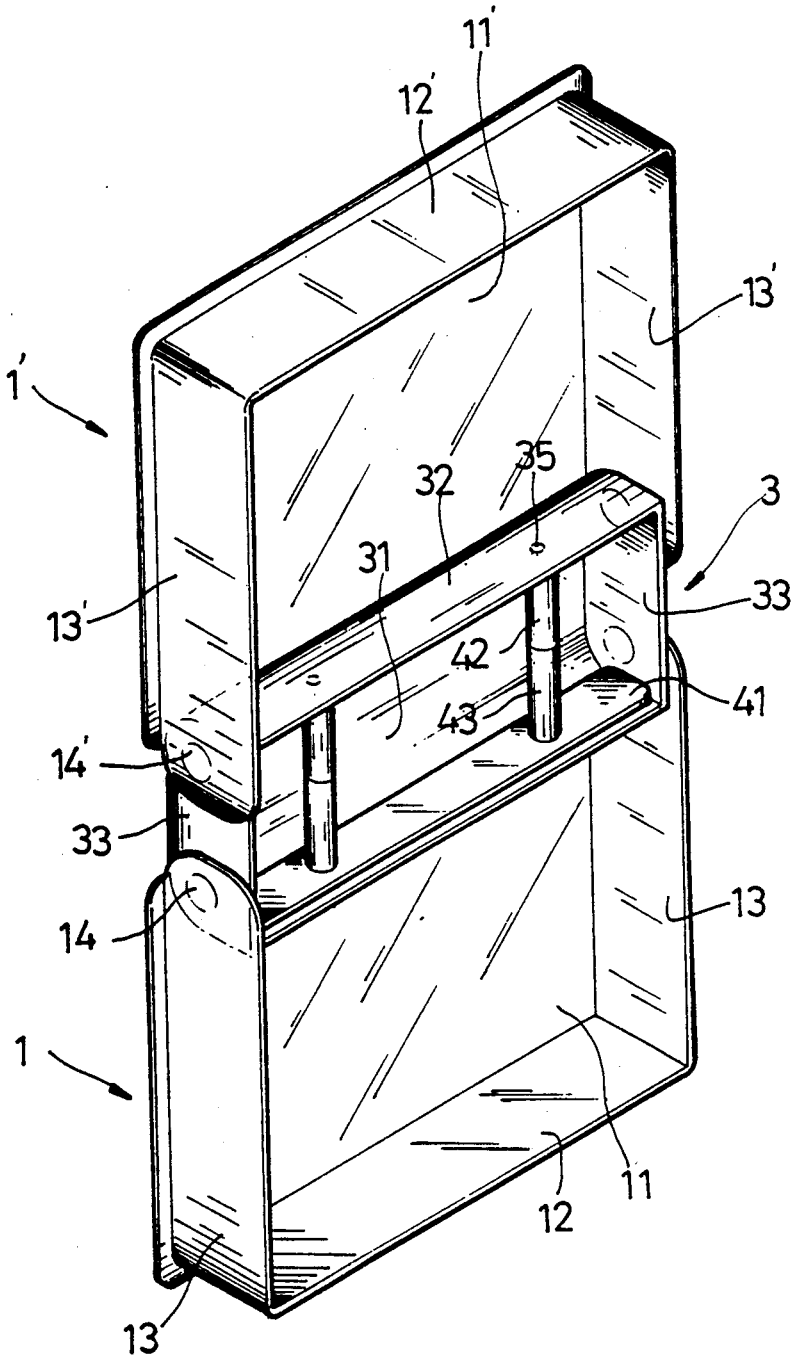
FIG. 2 is a precept view of the present invention according to FIG. 1.

Referring to FIG. 1, the present invention comprises opposite casings 1, 1' with the same shape, two related covers 2, 2', a side casing 3 connected between above casing 1 and 1', a binder means 4 and a plurality of loose bags 5. Each casing of 1 and 1' has a bottom plate 11, 11', a front face 12, 12' and opposite sides 13 and 13'. Each sides of 13 and 13' has formed thereon a pivot hole 14. The rectangle-shaped side casing 3 also has a bottom face 31, opposite faces 32 and opposite short sides 33. Each short side 33 has formed thereon two pivot pins 34 fitting the pivot holes 14 and, the opposite faces 32 have a width slightly less than that of front faces 12, 12', whereby the side casing 3 is connected between two casings 1, 1' and is detachable.

Figure 3:
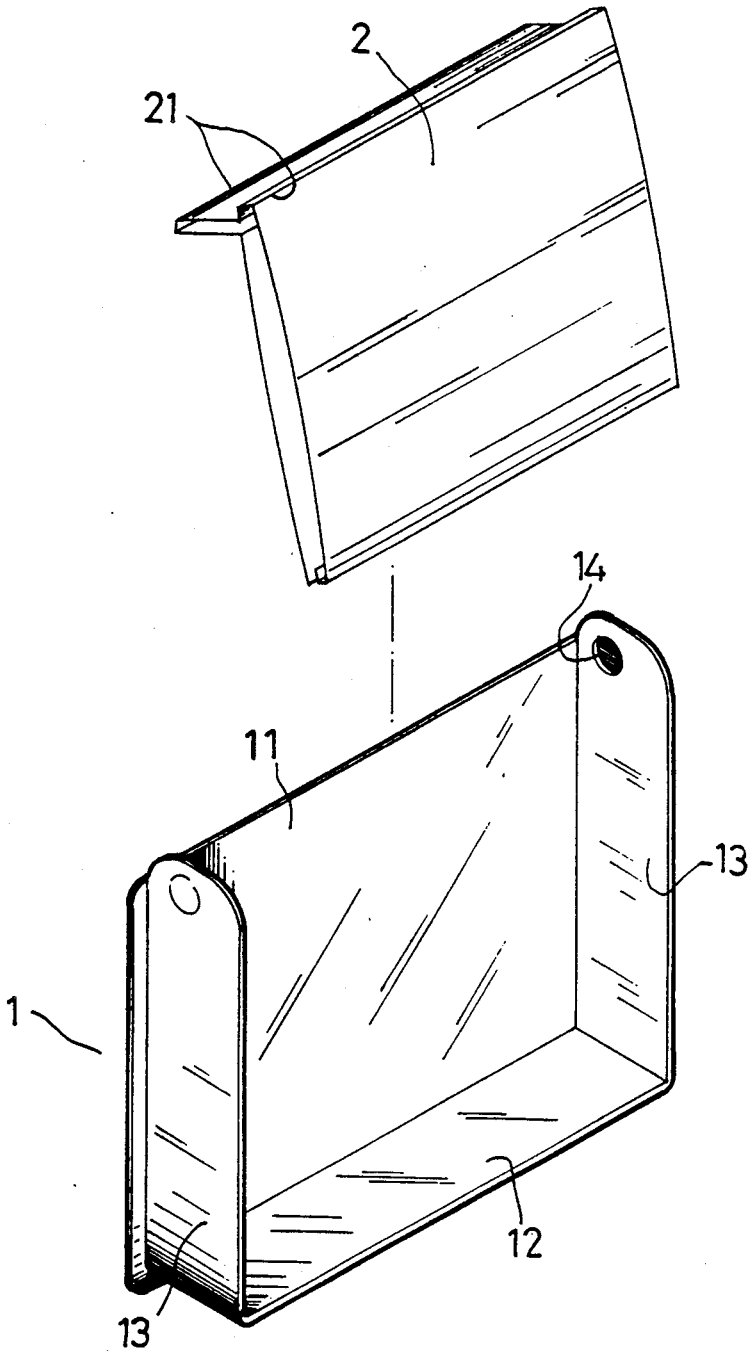
FIG. 3 is a perceptive view of one casing and cover of the present invention.
Figure 4:
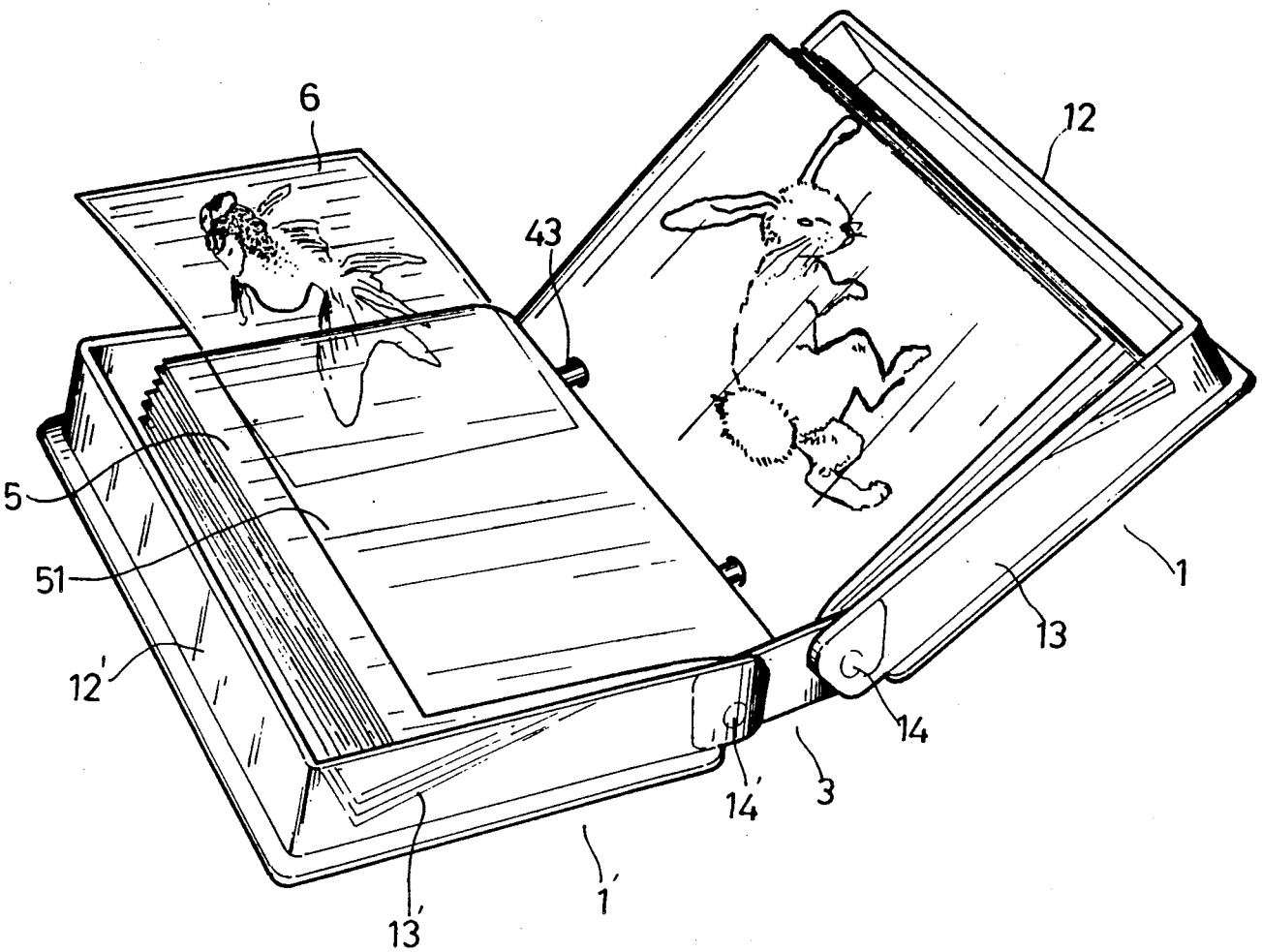
FIG. 4 is a perspective view of the present invention with pictures.

Referring to FIG. 3, two detachable covers 2, 2' respectively fitting the casings 1, 1' have a length slightly more than twice that of bottom plate 11 and front face 12 and, have formed thereon a plurality of folding lines 21 fitting the casings 1, 1', whereby the collector may insert his most favorite picture between the cover 2, 2' and casing 1, 1' to act as the cover of this photoalbum.

As same as the opposite casings 1, 1' and side casing 3, the binder means 4 is made of elastic material, such as plastic or acryl resin, and includes two opposite plates 41, and therefrom projecting at least two pairs of sticks, i.e. two male sticks 42 and two female sticks 43. The former have formed thereon connecting pins 421 and the latter have formed thereon connecting holes 431 mated the connecting pins 421. Each loose bag 5 has formed thereon at last two holes fitting the sticks 42, 43, and has inserted therein a sheet 51 to divide the bag 5 into two halves so as to contain two pictures 6 at a time. When two opposite plates 41 are combined together by their sticks 42, 43, the length of the binder means 4 is about the same as that of side casing 3. And by means of fixed pins 44 formed on the plates 41 and fixed holes 35 formed on the opposite faces 32, the binder means 4 may be fixed in the side casing 3, also may be detached from it directly due to its elasticity as an ordinary cassette.

There are just four steps to assemble the present invention, that is, first according to the folding lines 21, to respectively put the covers 2, 2' on the casing 1, 1', second to connect the side casing 3 with the opposite casing 1 and 1' by inserting the pivot pins 34 into the pivot holes 14; third to connect two plates 14 by inserting connecting pins 421 into connecting holes 422, meanwhile, the binder means 4 is assembled and loose bags 5 are hanged on the sticks 42, 43; and lastly to mount the binder means 5 with loose bags 5 in the side casing 3 by inserting fixed pins 44 into fixed holes 35.

When the present invention, photoalbum is assembled, the opposite casings 1, 1', which serve as bookcovers can freely rotate for a quarter of a circle by povit pin 34, and its horizontal and vertical dead positions are respectively formed by the points of the bottom plates 11, 11' of casing 1, 1' against projecting blocks 36 as shown in FIG. I and opposite faces 32 of side casing 3.

When the present invention is employed, the collector may insert the picture 6 into the loose bags 5. If he wants to rearrange the order of pictures 6, he can detach the binder means 4 from the sides casing 3 directly 3, separate the opposite plates 41 than arrange the loose bags 5 instead of pictures 6. And the abovesaid process of rearranging pictures 6 is believed more convenient than the conventional one.

As indicated, the structure herein may be variously embodied. Recognizing that various modifications will be apparent, the scope hereof shall be deemed to be defined by the claims as set forth below.

What is claimed is:

1. A detachable album, comprising:

two opposite upper and lower casings, wherein each said upper and lower casing includes a bottom plate, a front face and two opposite sides, and wherein each said side has formed thereon a pivot hole;

a side casing, including a bottom face, two opposite front and rear faces and two opposite short sides, wherein each said short side has formed thereon two pivot pins for cooperative engagement with said pivot holes, whereby said side casing may be connected between said two opposite upper and lower casings; and at least two opposite fixed holes also formed on said opposite front and rear faces;

a binder means, including two opposite plates, and projecting from each of said plates at least two male poles with connecting pins and two female poles with connecting holes for cooperative engagement with said connecting pins, whereby said opposite plates may be connected together, and wherein each said plate also has formed thereon at least one fixed pin for cooperative engagement with said fixed holes, whereby said binder may be mounted in said side casing; and a plurality of loose bags, wherein each said loose bag has inserted therein a sheet, and has formed thereon at least two holes fitting said poles, whereby said bags may be hanged on said poles.

2. The detachable album according to claim 1, further comprising two opposite covers folded along folding lines and fitting within said upper and lower casings and being maintained in said upper and lower casings by said side casing when said side casing is connected to said upper and lower casings.

3. the detachable album according to claim 1, wherein said opposite upper and lower casings, side casing and binder means are made of elastic material.

4. the detachable album according to claim 3, wherein said material is acrylic resin.

* * * * *